US007236604B2

(12) United States Patent
Tien

(10) Patent No.: US 7,236,604 B2
(45) Date of Patent: Jun. 26, 2007

(54) HEARING AID DEVICE

(76) Inventor: Der-Yang Tien, 19F., No. 70, Sec. 2, Dunhua S. Rd., Da-An District, Taipei (TW)

( * ) Notice: Subject to any disclaimer, the term of this patent is extended or adjusted under 35 U.S.C. 154(b) by 339 days.

(21) Appl. No.: 10/892,503

(22) Filed: Jul. 16, 2004

(65) Prior Publication Data

US 2005/0084124 A1 Apr. 21, 2005

(30) Foreign Application Priority Data

Oct. 15, 2003 (TW) ..... 92128527 A

(51) Int. Cl.
*H04R 25/00* (2006.01)

(52) U.S. Cl. ..... 381/312; 381/321

(58) Field of Classification Search ..... 381/60, 381/23.1, 312–316, 321, 331
See application file for complete search history.

(56) References Cited

U.S. PATENT DOCUMENTS 6,236,731 B1 * 5/2001 Brennan et al. ..... 381/312
7,020,296 B2 * 3/2006 Niederdrank ..... 381/312

* cited by examiner

*Primary Examiner*—Suhan Ni
(74) *Attorney, Agent, or Firm*—Morland C. Fischer

(57) ABSTRACT

A hearing aid device includes a signal transforming unit for converting an analog sound signal received by a signal receiving unit to a digital signal; a memory unit for temporarily storing the digital signal; a sound processing module for reprocessing the sound signal stored in the memory unit via a microprocessing unit according to parameters set by a user; a sound control module for receiving the sound signal processed by the sound processing module and adjusting an output volume via the microprocessing unit; and a signal output unit for receiving and outputting the sound signal adjusted by the sound control module. By such arrangement, a speed, tone and/or volume of an output sound can be controlled using the hearing aid device to thereby help the user to receive and recognize the sound signal.

10 Claims, 2 Drawing Sheets

HEARING AID DEVICE

FIELD OF THE INVENTION

The present invention relates to hearing aid devices, and more particularly, to a hearing aid device using a composite sound mechanism to help a user to receive sounds.

BACKGROUND OF THE INVENTION

The operation of human brain relies on processing different signals and data received from an outside environment by different sensory organs. Sources of the signals and data are mainly obtained via visual, auditory and kinesthetic senses. Thus these senses are critical for communication between people or between people and objects. Especially for children before school age, receiving external stimuli or signals via the auditory sense is of the same importance as that via the visual and kinesthetic senses. For example of learning speech, if a child is deaf and cannot successfully receive external sound signals, he or she fails to repeat the sound signals to learn speech. Moreover, loss of hearing for an adult also causes inconvenience in communication and may put this person in unconscious danger since humans usually rely on hearing to receive external sound signals and determine environmental changes. For example, a car accident may occur when a pedestrian who is hard of hearing is unable to receive the sound signals and notice a car coming behind.

In a medical aspect, hearing loss includes conductive hearing loss, sensory-neural hearing loss, mixed hearing loss and central hearing loss. Many hearing loss cases can be solved by internal medical methods, and most cases of conductive hearing loss can be treated through surgery. The sensory-neural hearing loss is usually screened during a child health examination to be diagnosed and treated in an early stage. Alternatively, a hearing aid device or various ways of language rehabilitation such as learning of lip language, oral language, sign language and auditory training so as not to impair the language development and learning of knowledge.

Therefore, For some of the hearing loss people especially those having the sensory-neural hearing loss, the hearing aid device is an essential auxiliary tool. The hearing aid device is actually a small loudspeaker, which amplifies the sound signals originally not detectable for the hearing loss people and transmits the amplified sound signals to a hearing center of the brain through the very weak hearing of the hearing loss people so as to allow them to receive the sound signals. An electronic hearing aid device has been used since early of the twenty century, and its basic structure including a microphone, an amplifier, a receiver and a power source always remains similar. However, the hearing aid device becomes reduced in the size of its component parts, and has gradually improved sound quality, as well as provides more control options. The microphone is to collect sounds and converts the collected sounds to voltage. The amplifier increases the voltage intensity. The receiver converts the increased voltage back to a sound wave. The power source supplies power for operating the hearing aid device. A housing is also provided for encapsulating and protecting the hearing aid device.

Although the foregoing hearing aid device can desirably allow some of the hearing loss people to receive the external sound signals, it functions simply to amplify the sound signals and clarify the amplified sounds, which may not be useful for all hearing loss people. Particularly, the hearing loss for the elders with increase in age is caused by aging of villi of hair cells in their inner ears by which the external sound signals are less likely to stimulate auditory nerves and to be perceived by the hearing center of the brain.

Once the villi became aged, the hearing loss people are not only unable to recognize soft sounds but also unable to recognize sounds with close sequential cues from extremely close words of fast speech. Furthermore, a tone level of a speaker also influences recognition by a listener especially for one who is hearing impaired. However, the currently available hearing aid devices do not relate to this problem nor solving it.

Therefore, the problem to be solved here is to provide a hearing aid device that can improve an auditory condition for hearing loss people according to causes of the hearing loss.

SUMMARY OF THE INVENTION

In light of the above prior-art drawback, a primary objective of the present invention is to provide a hearing aid device that can improve articulation of received external sound signals through the use of sound processing and control mechanisms.

Anther objective of the present invention is to provide a hearing aid device that can adjust a speed of an output sound according to a user's setting through the use of sound processing and control mechanisms so as to allow the user to more easily recognize received sound signals.

Still another objective of the present invention is to provide a hearing aid device that can adjust a tone of output sounds according to a user's setting through the use of sound processing and control mechanisms so as to allow the user to more easily recognize received sound signals.

A further objective of the present invention is to provide a hearing aid device that can convert received sound signals to different linguistic sound signals, so as to facilitate received sound signals of different languages to be recognized by a user.

In accordance with the above and other objectives, the present invention proposes a hearing aid device comprising a signal receiving unit for receiving an external analog sound signal for the hearing aid device; a signal transforming unit for converting the analog sound signal received by the signal receiving unit to a digital sound signal; a memory unit for temporarily storing the digital sound signal converted by the signal transforming unit and other digital signals processed by other units and modules of the hearing aid device; a sound processing module for reprocessing the sound signal stored in the memory unit via a microprocessing unit of the hearing aid device according to parameters set by a user; a sound control module for receiving the sound signal processed by the sound processing module and adjusting an output volume of the sound signal via the microprocessing unit; and a signal output unit for receiving and outputting the sound signal adjusted by the sound control module.

In comparison to the conventional hearing aid device in the prior art, the hearing aid device proposed in the present invention is capable of improving articulation of received external sound signals through the use of the sound processing and control mechanisms and also adjusting the speed and tone of an output sound according to the user's setting, such that the user can more easily recognize the received sound signals. Furthermore, the received sound signals can be converted to different linguistic sound signals to improve sound recognition for the user.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
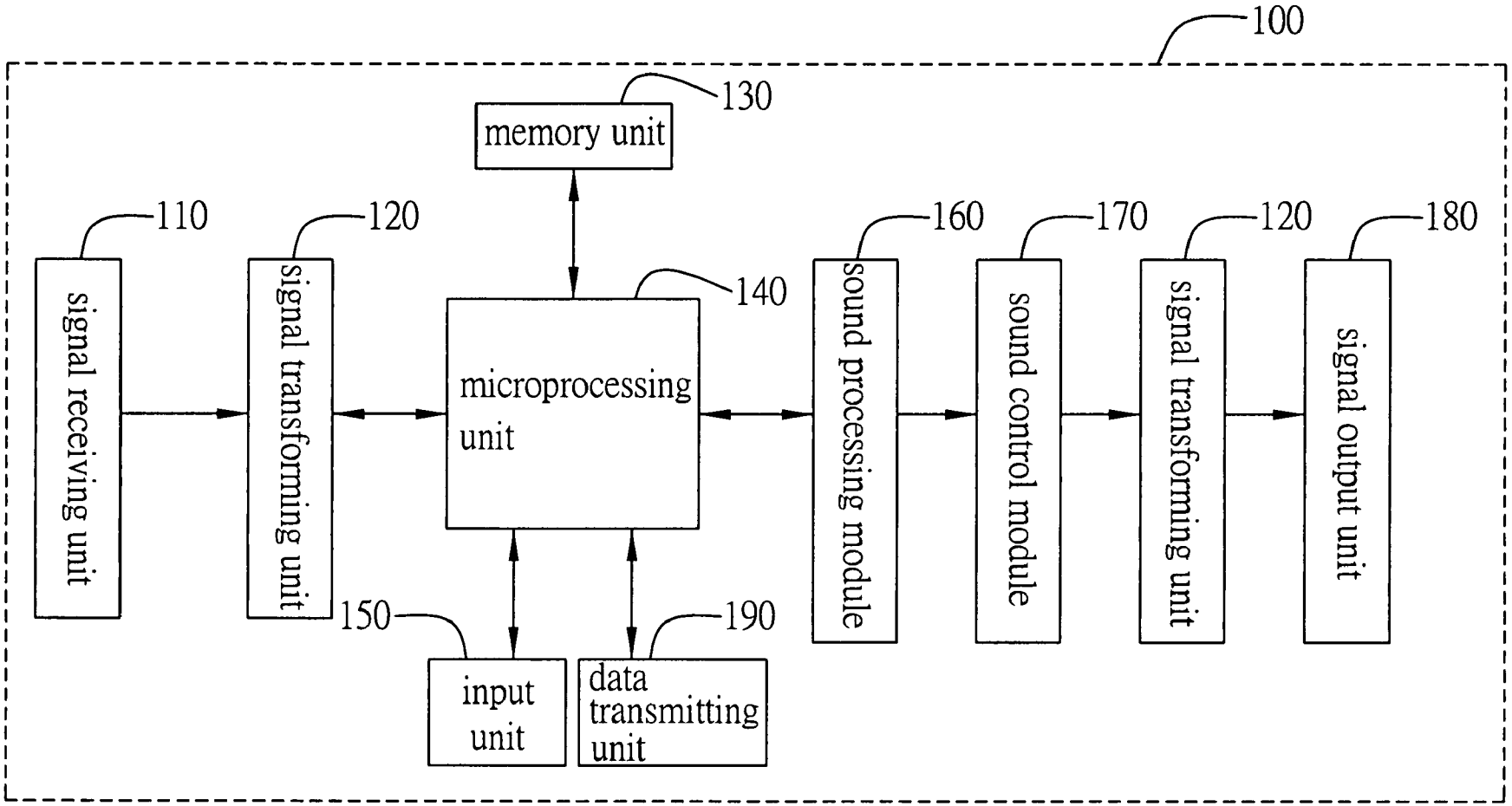
FIG. 1 is a schematic diagram showing a basic structure of a hearing aid device according to the present invention.

FIG. 1 shows a basic structure of a hearing aid device 100 proposed in the present invention. The hearing aid device 100 comprises a signal receiving unit 110, a signal transforming unit 120, a memory unit 130, a microprocessing unit 140, an input unit 150, a sound processing module 160, a sound control module 170, a signal output unit 180, and a data transmitting unit 190. It should be noted that the hearing aid device 100 practically further comprises some other units and/or modules required for operation. However, the specification merely disclose the units and modules related to the present invention to emphasize the technical features of the present invention.

The signal receiving unit 110 is to receive an external sound signal for the hearing aid device 100 and converts the received sound signal to a voltage signal. In this embodiment, the signal receiving unit 110 can be a microphone.

The signal transforming unit 120 is to convert the analog sound signal received by the signal receiving unit 110 to a digital signal. Sound is analog and can be represented by any value within a continuous range. For the hearing aid device 100 in the present invention, the sound signal should be a digital signal to be stored in the memory unit 130 and processed by other units or modules. Thus, the signal transforming unit 120 converts the analog sound signal to the digital form of "0" or "1" through analog signal sampling so as to allow the digital signal to be stored in the memory unit 130 and processed by other units or modules. Moreover, the signal transforming unit 120 can also convert a digital signal to an analog signal to be subsequently processed by the sound control module 170.

The memory unit 130 may be a random access memory (RAM) where modules or units of the hearing aid device 100 can quickly store and access the required data. The RAM can be for example a static random access memory (SRAM), dynamic random access memory (DRAM), synchronous dynamic random access memory (SDRAM) or double data rate SDRAM (DDRSDRAM).

The microprocessing unit 140 is to provide signal retrieval, decoding and command execution functions for the hearing aid device 100, and can transmit or receive data to or from other sources via a data transmitting path such as a universal serial bus (USB).

The input unit 150 allows a user to enter data and/or commands for operating and controlling the hearing aid device 100. In this embodiment, the input unit 150 comprises a plurality of buttons. Additionally, the hearing aid device 100 may further comprise a display unit (not shown) to show an operating status of the hearing aid device 100. This display unit can be a liquid crystal display (LCD), or preferably a touch-panel LCD that can be combined to the input unit 150.

The sound processing module 160 is to reprocess the sound signal stored in the memory unit 130 by using the microprocessing unit 140 according to parameters set by the user through the input unit 150. In this embodiment, the sound processing module 160 can adjust a speed and/or tone of an output sound from the digital sound data that has been received by the signal receiving unit 110 and converted by the signal transforming unit 120 to be temporarily stored in the memory unit 130. For example, the speed of the digital sound data can be increased or decreased by changing the timing sequence. Moreover, the tone level of the sound is positively correlated with the speed of the vibration. The sound wave having a higher vibration speed is associated with a higher frequency and a higher tone level. As a result, the digital sound data can be altered by adjusting the frequency of the data.

The sound control module 170 is to receive the sound signal reprocessed by the sound processing module 160 and adjust an output volume using the microprocessing unit 140. As previously described, in this embodiment, after the signal sound data is reprocessed by the sound processing module 160 and temporarily stored in the memory unit 130, the reprocessed signal sound data is subsequently converted to an analog sound signal by the signal transforming unit 120. The sound control module 170 comprises at least one signal amplifying circuit (not shown) for amplifying the analog signal converted by the signal transforming unit 120. The sound control module 170 can amplify an output level of the analog sound signal according to an output signal size set by the user via the input unit 150.

The signal output unit 180 is to receive and output the sound signal adjusted by the sound control module 170. In this embodiment, the signal output unit 180 can be a loudspeaker for receiving the level signal from the sound control module 170 to actuate loudspeaker units to push the air and generate sound waves.

The data transmitting unit 190 is to connect the hearing aid device 100 to an external device via a wired or wireless connection, such that the signal data can be transmitted and received between the hearing aid device 100 and the external device. In this embodiment, the data transmitting unit 190 can be a wireless data transmitting interface such as radio frequency transmitting interface, infrared transmitting interface and/or bluetooth transmitting interface. Alternatively, the data transmitting unit 190 can also be a wired data transmitting interface such as universal serial bus (USB) and/or IEEE (Institute of Electrical and Electronics Engineers) 1394.

Figure 2:
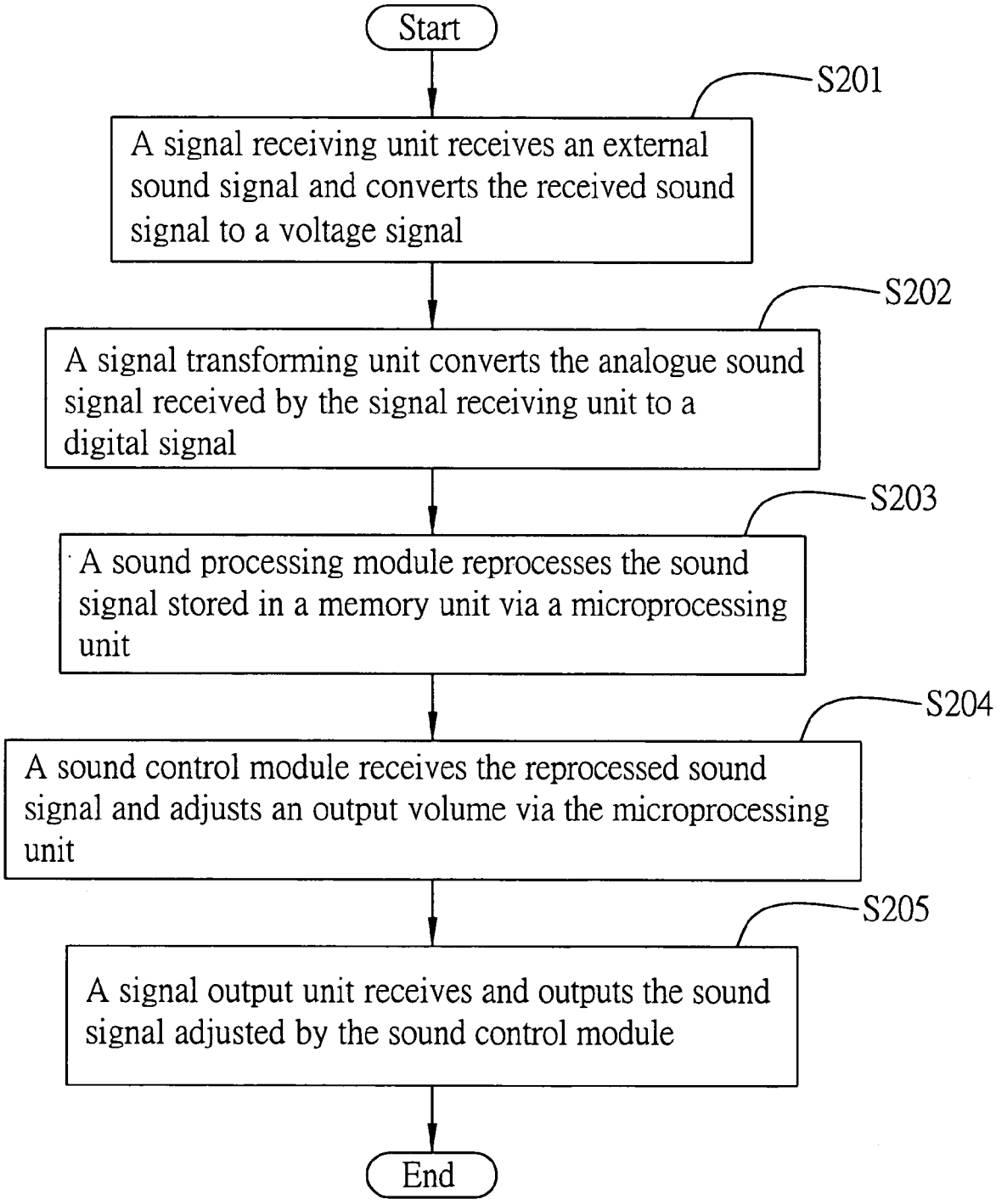
FIG. 2 is a flowchart showing operating steps of using the hearing aid device according to a preferred embodiment of the present invention.

FIG. 2 shows operating steps of using the hearing aid device 100 according to a preferred embodiment of the present invention.

In step S201, the signal receiving unit 110 is actuated to receive an external sound signal and subsequently convert the received sound signal to a voltage signal. Then, it proceeds to step S202.

In step S202, the signal transforming unit 120 is actuated to convert the analog sound signal received by the signal receiving unit 110 to a digital signal that is subsequently stored in the memory unit 130 and processed by other units or modules. Then, it proceeds to step S203.

In step S203, the sound processing module 160 is actuated to reprocess the sound signal stored in the memory unit 130 by using the microprocessing unit 140 according to parameters set by the user via the input unit 150. Then, it proceeds to step S204.

In step S204, the sound control module 170 is actuated to receive the sound signal reprocessed by the sound processing module 160 and adjust an output volume using the microprocessing unit 140. Then, it proceeds to step S205.

In step S205, the signal output unit 180 is actuated to receive and output the sound signal adjusted by the sound control module 170.

Therefore, the hearing aid device proposed in the present invention is capable of improving articulation of received external sound signals through the use of sound processing and control mechanisms, and also adjusting the speed and tone of an output sound according to the user's setting, such that the user can more easily recognize the received sound signals. Furthermore, the received sound signals can be converted to different linguistic sound signals to improve sound recognition for the user.

In addition to the foregoing embodiments, the hearing aid device proposed in the present invention may further cooperate with a non-volatile storage unit such as hard disk or flash memory and a test to speech (TTS) system so as to convert received recognizable analog voice data to digital voice data as well as translate the digital voice data to corresponding digital voice data of other languages. Therefore, a voice translation function can be achieved by transmitting the translated sound signal to the user through the TTS system.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A hearing aid device comprising:

a signal receiving unit for receiving an external analog sound signal for the hearing aid device;

a signal transforming unit for converting the external analog sound signal received by the signal receiving unit to a digital sound signal;

a memory unit for temporarily storing the digital sound signal converted by the signal transforming unit;

a microprocessing unit;

a sound processing module for processing the digital sound signal stored in the memory unit via the microprocessing unit according to parameters set by a user;

a sound control module for receiving the digital sound signal processed by the sound processing module and adjusting an output volume of the digital sound signal via the microprocessing unit; and a signal output unit for receiving and outputting the sound signal adjusted by the sound control module, wherein the sound processing module also adjusts at least one of a speed and a tone of an output sound from said digital sound signal according to the parameters set by the user.

2. The hearing aid device of claim 1, further comprising an input unit for the user to enter data and/or commands for operating and controlling the hearing aid device.

3. The hearing aid device of claim 1, further comprising a data transmitting unit for connecting the hearing aid device to an external device so as to allow signal data to be transmitted between the hearing aid device and the external device.

4. The hearing aid device of claim 3, wherein the data transmitting unit is a wireless data transmitting interface selected from the group consisting of a radio frequency transmitting interface, an infrared transmitting interface, and a Bluetooth transmitting interface.

5. The hearing aid device of claim 3, wherein the data transmitting unit is a wired data transmitting interface selected from the group consisting of a universal serial bus (USB) and an IEEE (Institute of Electrical and Electronics Engineers) 1394.

6. The hearing aid device of claim 1, wherein the signal receiving unit is a microphone.

7. The hearing aid device of claim 1, wherein the signal transforming unit is one of an analog-to-digital or a digital-to-analog signal converter.

8. The hearing aid device of claim 1, wherein the memory unit is selected from the group consisting of a static random access memory (SRAM), a dynamic random access memory (DRAM), a synchronous dynamic random access memory (SDRAM), and a double data rate SDRAM (DDRSDRAM).

9. The hearing aid device of claim 1, wherein the signal output unit is a loudspeaker.

10. The hearing aid device of claim 1, further comprising a text to speech (TTS) system for translating the digital sound data to corresponding digital sound data of other languages.

* * * * *